US006144153A

United States Patent [19]

Nakatani

[11] Patent Number: 6,144,153

[45] Date of Patent: Nov. 7, 2000

[54] SPACER SUPPORT FOR DISPLAY DEVICE

[75] Inventor: Tadashi Nakatani, Kawasaki, Japan

[73] Assignee: Fujitsu Limited, Kanagawa, Japan

[21] Appl. No.: 09/000,885

[22] Filed: Dec. 30, 1997

[30] Foreign Application Priority Data

Aug. 19, 1997 [JP] Japan ..... 9-222755

[51] Int. Cl.[7] ..... H01J 1/62; H01J 63/04

[52] U.S. Cl. ..... 313/495; 313/292

[58] Field of Search ..... 313/309, 336, 313/351, 495, 292, 257, 265

[56] References Cited

U.S. PATENT DOCUMENTS 5,834,891 11/1998 Novich ..... 313/495

5,864,205 1/1999 Dworsky ..... 313/495

*Primary Examiner*—Vip Patel

*Assistant Examiner*—Michael J. Smith

*Attorney, Agent, or Firm*—Arent Fox Kintner Plotkin & Kahn

[57] ABSTRACT

A display device includes a cathode plate having a minute field emission cathode to emit electrons into an area defining a pixel, a spacer support member, and an anode plate placed between the cathode plate and the spacer support member, the anode plate having a fluorescent layer in the area defining the pixel, wherein the spacer support member is provided with a plurality of pole members for contacting the cathode plate and supporting the cathode plate against atmospheric pressure, the pole members extending vertically toward the cathode plate from a surface of the spacer support member and passing through a plurality of through-holes provided on the anode plate without contacting the anode plate.

4 Claims, 15 Drawing Sheets

SPACER SUPPORT FOR DISPLAY DEVICE

CROSS REFERENCE TO RELATED APPLICATION

This application is related to Japanese application No. HEI 9(1997)-222755 filed on Aug. 19, 1997, whose priority is claimed under 35 USC §119, the disclosure of which is incorporated by reference in its entirety.

BACKGROUND OF THE INVENTION

1. Field of the Invention

The present invention relates to a display device, particularly to a flat display device using minute field emission cathodes.

The minute field emission cathode is an electron source of a higher electron emission efficiency and a higher luminosiy than a thermionic cathode, which is conventionally used, and is a promising electron source for a flat display, an image pickup tube and the like. Particularly, a display device employing the minute field emission cathodes is of a self-luminous type, and can exhibit a higher luminance and a higher resolution. Further, the display device has various excellent characteristics such as wide view angle, quick response and low power consumption.

2. Description of Related Art

Some display devices employing cathodes comprises a vacuum-sealed container in which electrons extracted from field emission cathodes are accelerated by applying an electric field and irradiated onto a fluorescent substance to emit light. As such cathodes, used are conical or planar minute field emission cathodes and surface conduction type cathodes.

FIG. 13 shows an exemplary construction of a display device employing conventional minute field emission cathodes.

The minute field emission cathode includes conical emitter tips 101, gate electrode lines (gate power supply lines) 103 for extracting electrons, emitter electrode lines (emitter power supply lines) 102 for applying a negative voltage to the emitter tips, and an insulation film 104 for isolating the gate electrode lines from the emitter electrode lines. The minute field emission cathode is disposed on a glass substrate 105 as shown in FIG. 14. The entire cathode structure including the glass substrate 105 is herein called a cathode plate 109.

The emitter tip 101 is about one micronmeter in length and is formed by integration on a flat substrate employing a micromachining technique.

The emitter electrode lines 102 and the gate electrode lines 103 are arranged so as to intersect each other. In each intersection, several hundred to several thousand emitter tips are formed on the emitter electrode line. These several hundred to several thousand emitter tips define one display element, e.g., pixel, 106.

When a voltage is applied across the emitter tip 101 and the gate electrode line 103 in vacuum, electrons are extracted from the emitter tip 101 by field emission.

Since the field emission characteristic is non-linear, both the emitter electrode lines and the gate electrode lines can be driven by simple matrix addressing. Electrons extracted from emitter tips in a selected pixel impinge on a transparent anode plate 107 supported in an opposed relation to the minute field emission cathode.

The anode plate 107 has fluorescent layers 108 formed in a stripe pattern on its surface. When electrons impinge on these fluorescent layers 108, the fluorescent layers 108 are excited to emit light. A user observes this light emission through the anode plate 107 or the cathode plate 109.

In order to accelerate electrons, an acceleration voltage of several hundred volts must be applied to the anode plate 107 with respect to the cathode plate. Here, the anode plate and the cathode plate should be spaced about several hundred micrometers for ensuring good insulation therebetween.

Generally, the luminance of a display screen is proportional to the luminous efficiency of a fluorescent layer.

The higher acceleration voltage is applied to the anode, the higher the luminous efficiency becomes, because electrons can penetrate deeper into particles of the fluorescent layer. Therefore, it is preferable for increasing the luminous efficiency to reduce the space between the anode plate and the cathode plate and raise the acceleration voltage applied to the anode.

FIG. 14 shows a sectional view of a display device of a reflection type wherein a cathode plate is placed on a observer's side and light emitted by a fluorescent layer is observed by a user in a reflective form. An acceleration voltage 112 is applied across gate electrode lines 103 and electrically conductive films 110 on an anode plate 107. Electrons emitted by emitter tips 101 is irradiated onto fluorescent layers deposited on the surface of the conductive films 110. Here, the acceleration voltage 112 is about 400V.

Referring to FIG. 14, a plurality of spacers 111 are disposed at proper intervals between the anode plate 107 and the cathode plate 109 to ensure a certain spacing between the anode plate 107 and the cathode plate 109. The inside of a panel defined by the anode plate 107 and the cathode plate 109 is vacuumed. The spacers 111 are formed of a glass material of 200 $\mu$m high, and adhered to the anode plate 107 and the cathode plate 109 to support both the anode and cathode plates against atmospheric pressure.

In this construction, if the acceleration voltage 112 is raised higher than 400V, a sudden electric discharge is caused to occure on the surface of the spacers 111 by ions or secondary electrons generated in the panel. This electric discharge often induces destruction of emitter tips 101.

If the spacers 111 are heightened to allow a larger spacing between the anode plate 107 and the cathode plate 109, it increases a creeping distance between the electrode lines 103 of the cathode plate 109 and the conductive films 110 on the anode plate 107 through the surface of the spacers. The increased creeping distance means an increased insulation voltage between the plates, and as a result, the above-mentioned electric discharge and destruction of the emitter tips can be prevented.

However, electrons emitted by the emitter tips 101 travel in a radially spreading manner. Accordingly, the larger the spacing between the plates is, the more a beam of electrons spread, and as a result, resolution deteriorates. Especially in a color display device, electrons expected to be incident on one fluorescent layer may impinge on an adjacent fluorescent layer of a different color, which results in the blurring of colors.

Since the emitter tips 101 cannot be formed in areas where the spacers 111 is disposed, light is not emitted from these areas. Accordingly, in order to obtain a resolution of about 300 $\mu$m, for example, the width of the spacers 111 is preferably about 40 $\mu$m or less.

In the case where the spacing between the anode plate and the cathode plate is about 200 $\mu$m, the insulation voltage is generally about 500V. Accordingly, a spacing of 2 mm is required between the anode and cathode plates in order to obtain a insulation voltage of 5 kv. In this case, an aspect ratio of the spacers 111 is 50:1 (=2 mm:40 $\mu$m). It is difficult to form a spacer which exhibits such a high aspect ratio and sufficient strength at the same time. Even if a spacer of this configuration is formed, for example, by cutting a glass fiber, the spacer readily falls down or inclines since the spacer is adhered to the plates only by an extremely small area.

A high aspect ratio can be more easily obtained by forming a spacer in a shape like an elongated wall. In a display as shown in FIG. 14, however, since gas within the panel is discharged in a direction parallel to the plates, a gas discharge conductance declines if wall-like spacers are formed. The decline in the gas discharge conductance results in a fall in a vacuum degree around the emitter tips because the fluorescent layers on which electrons impinge release gas or the like. That brings about defects in display by a decline in the luminance and by the destruction of emitter tips.

SUMMARY OF THE INVENTION

The present invention has been made in view of the above circumstances, and an object thereof is to provide a display device exhibiting a higher luminance mainly by improving the structure of spacers. Another object of the present invention is to provide a display device exhibiting an improved insulation voltage between an anode plate and a cathode plate in addition to a high luminance while maintaining a high resolution and a high vacuum degree within a panel.

The present invention provides a display device comprising a cathode plate having a minute field emission cathode to emit electrons into an area defining a pixel, an anode plate having a fluorescent layer in the area defining the pixel, and a spacer support member, wherein the anode plate is placed between the cathode plate and the spacer support member, or the cathode plate is placed between the anode plate and the spacer support member.

Further, the present invention provide a display device, wherein, when the anode plate is placed between the cathode plate and the spacer support member, the anode plate has a plurality of through-holes, and the spacer support member is provided with a plane plate and a plurality of pole members for contacting the cathode plate and supporting the cathode plate against atmospheric pressure, the pole members extending vertically toward the cathode plate from a surface of the plane plate and passing through a plurality of through-holes provided on the anode plated without contacting the anode plate. The pole members are hereinafter referred to as spacers.

DESCRIPTION OF THE PREFERRED EMBODIMENTS

The present invention also provides a display device comprising a cathode plate having a minute field emission cathode to emit electrons into an area defining a pixel, an anode plate placed opposedly to the cathode plate, the anode plate having a fluorescent layer in the area defining the pixel on a surface facing the cathode plate, a plurality of spacers to maintain a predetermined spacing between the cathode plate and the anode plate, and a support member to support the spacers, the support member being placed on a rear surface of the anode plate other than the surface of the anode plate on which the fluorescent layer is formed, wherein the anode plate has a plurality of through-holes, each of the spacers is inserted into one of the through-holes without contacting the anode plate, one end of each of the spacers contacts the cathode plate and the other end thereof contacts the support member, and the spacers connect with the anode plate through the support member on the rear surface of the anode plate. This support member is hereinafter referred to as a rear support. With this construction, the display device exhibits a higher luminance and improved insulation voltage.

Further, the present invention provide a display device comprising a cathode plate having a minute field emission cathode to emit electrons into an area defining a pixel, an anode plate placed opposedly to the cathode plate, the anode plate having a fluorescent layer in the area defining the pixel on a surface facing the cathode plate, a spacer support member in a lattice form placed in a space defined by the cathode plate and the anode plate, wherein the spacer support member has a plurality of through-holes opening in a direction from the cathode plate to the anode plate, and the though-holes correspond to the areas defining pixels. With this construction, the display device maintains a high vacuum degree and exhibits a high luminance. When the display device is used for color display, the blurring of colors can be prevented.

The present invention is further explained in detail by way of embodiments with reference to the accompanying drawings which are not intended to limit the scope of the invention.

EXAMPLE 1

Figure 1:
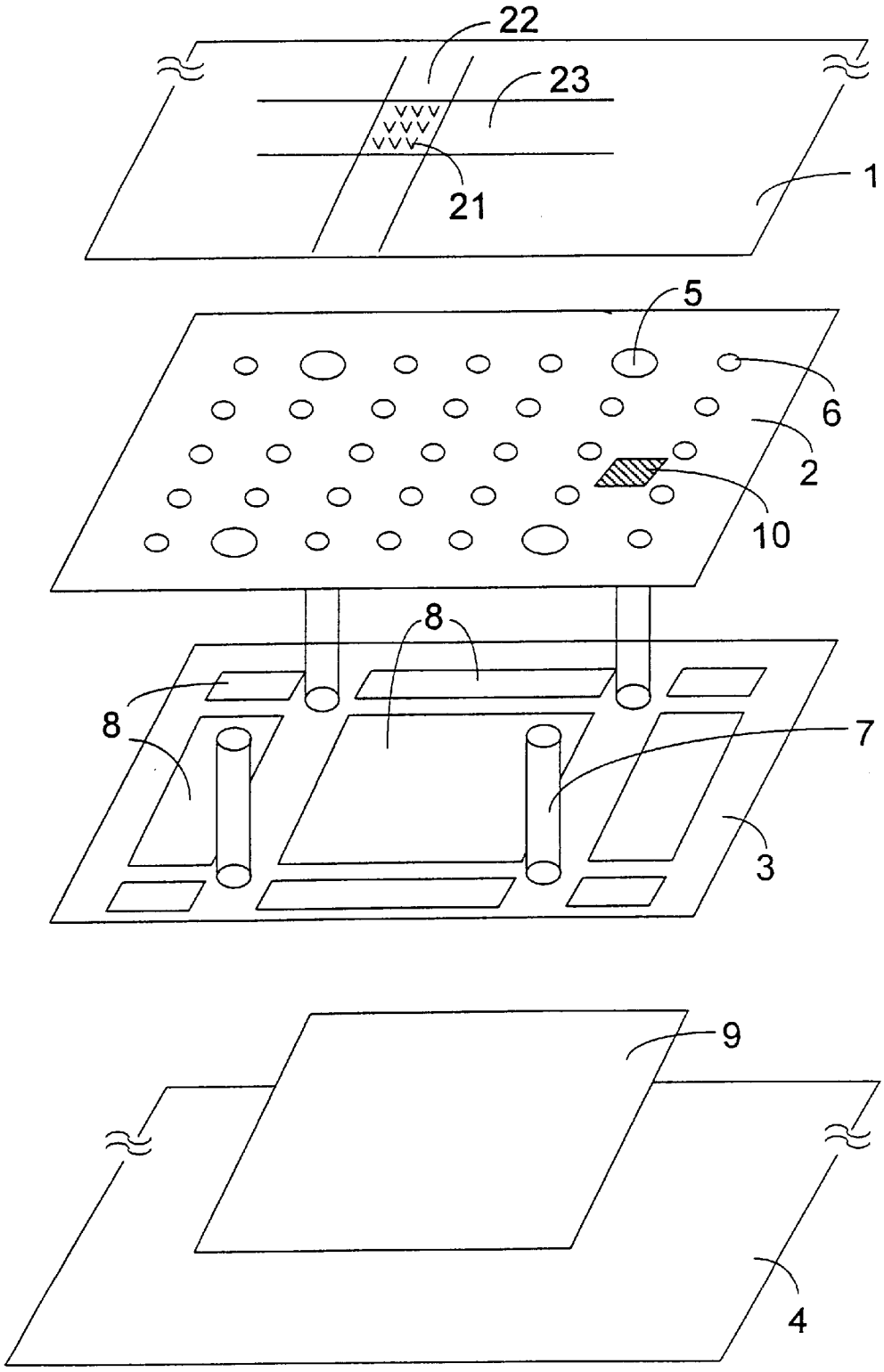
FIG. 1 is a schematic view illustrating the construction of a display device in accordance with Example 1 of the present invention.

FIG. 1 is a schematic view illustrating the construction of a display device in accordance with Example 1 of the present invention.

Figure 2:
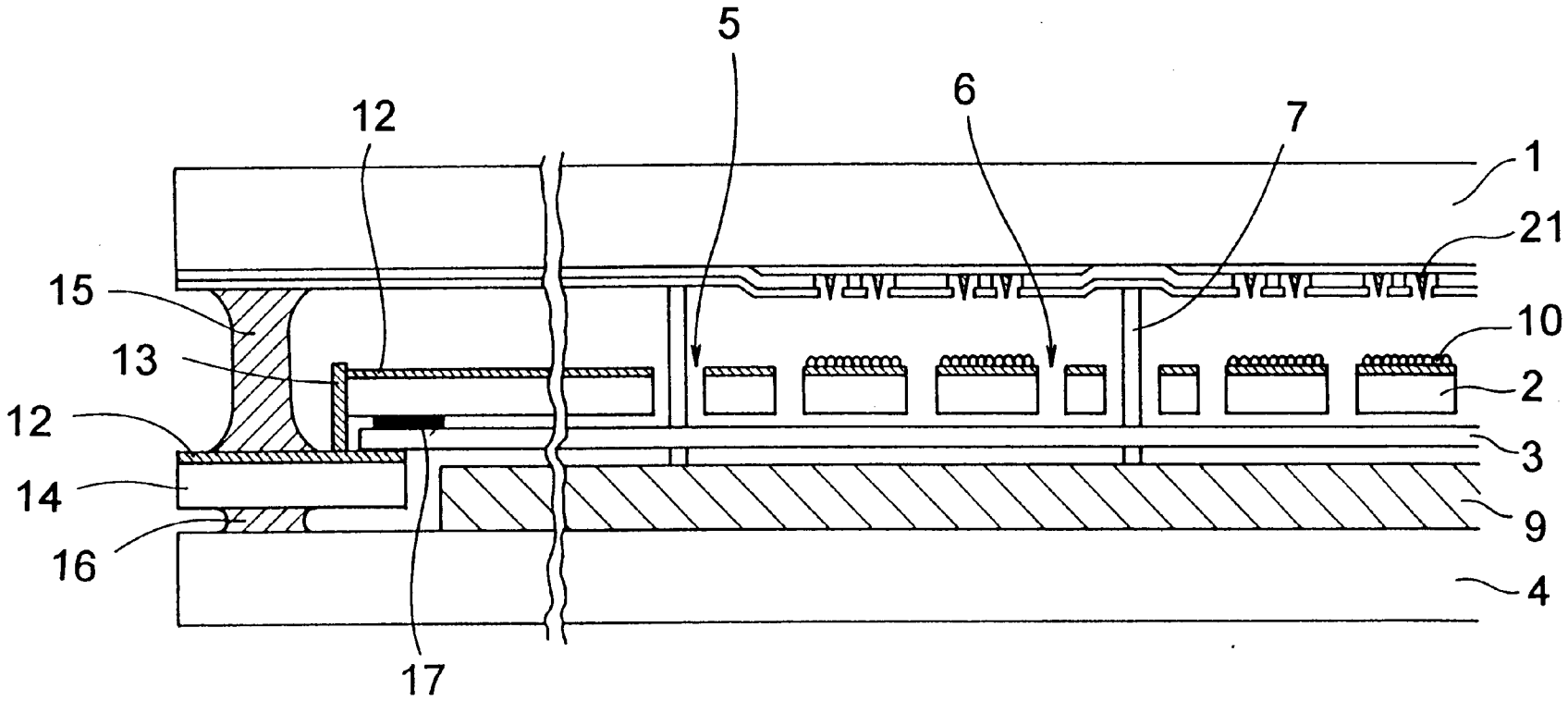
FIG. 2 is a sectional view of the display device in accordance with Example 1 of the present invention.

The display is of a reflection type and mainly composed of a cathode plate 1 placed on an observer's side, an anode plate 2 placed on a rear side, a spacer support plate 3, a getter 9 in a sheet form and a getter support plate 4, as shown in FIG. 1. FIG. 2 is a sectional view of the display shown in FIG. 1.

The cathode plate 1 is a glass substrate on which a field emission cathode is disposed. The field emission cathode includes emitter tips 21, gate electrode lines 22, and emitter electrode lines 23. An area in which emitter tips are formed, i.e., an area in which the gate electrode line intersects the emitter electrode line, is an area defining a pixel. This area is hereinafter referred to as a pixel area.

The anode plate 2 is a substrate which may be made of glass, silicon or crystal. The anode plate 2 is opposed to the cathode plate and is provided with through-holes in areas other than pixel areas. On a surface of the anode plate facing the cathode plate, electrically conductive films 12 (electrodes) are spaced for applying a voltage.

On the conductive films 12, fluorescence layers 10 are formed in the pixel areas.

The through-holes include two groups of through-holes. One group of through-holes are spacer through-holes 5 for letting through the below-described spacers 7 and each of the through-holes is about 70 $\mu$m in size. The other group of through-holes are gas discharge through-holes 6 for discharging gas and the like generated when electrons emitted from the emitter tips 21 impinge on the fluorescent layers 10 and the like, toward the sheet getter 9.

Here, in order to discharge the gas toward the sheet getter 9 sufficiently, the gas discharge through-holes 6 are preferably formed all over the anode plate in great number to occupy as large an area as possible of the whole area of the anode plate. Further, it is preferable that the gas discharge through-holes 6 are formed proximately to the pixel areas. For example, the gas discharge through-holes 6 are arranged in matrix at regular intervals of about 150 $\mu$m. The spacer through-holes 5 are formed in the same number as the spacers 7.

The spacer support plate 3 may be made of glass, silicon or crystal, and has large through-holes 8 in most areas corresponding to areas for displaying images as shown in FIG. 1. The through-holes 8 are for efficiently discharging the gas having passed through the spacer through-holes 5 and the gas discharge through-holes 6, to the sheet getter 9 disposed below the spacer support plate 3.

On a surface of the spacer support plate 3 facing the anode plate 2, the spacers 7 are formed to extend to the cathode plate 1. The spacers 7 may be made of the same material as the spacer support plate 3, e.g., glass, silicon or crystal. The spacers 7 pass through almost the center of the spacer through-holes 5 formed on the anode plate 2, and ends of the spacers 7 contact a surface of the cathode plate 1. The spacers 7 do not contact the anode plate 2.

The spacers 7 are placed in areas other than the pixel areas.

In order to support the cathode plate 1 and the getter support plate 4 against atmospheric pressure, it is preferable that a plurality of spacers 7 are arranged at proper intervals. Referring to FIG. 1, the number of the spacers 7 is four. However, the number thereof is not limited thereto, and the spacers may be provided in any number which can steadily maintain a predetermined spacing between the cathode plate 1 and the anode plate 2. The thinner the cathode plate 1 and/or getter support plate 4 are formed, the more the display device is likely to bend. Accordingly, in such a case, a larger number of spacers are required to be mounted.

The spacer 7 may be formed in a cylindrical form of about 250 $\mu$m long (high) and of diameter about 40 $\mu$m, but is not limited to this shape. The spacer may be formed in a prism shape. The spacer 7 has a resin coating of about 10 $\mu$m in thickness on its surface and is adhered to the spacer support plate 3 with fritted glass.

The sheet getter 9 may be one of a non-evaporation type made of a material such as zirconium or one of an evaporation type made of a material such as barium deposition film. The height (thickness) thereof is about 120 $\mu$m. The getter support plate 4 is made of a material such as glass or ceramic.

As shown in FIG. 2, the sheet getter 9 is adhered to the getter support plate 4, and the spacer support plate 3 is placed above the sheet getter 9.

A display frame 14 of glass or the like is provided in a peripheral portion surrounding the display area. The display frame 14 is adhered to the cathode plate 1 and the getter support plate 4 with sealing members 15 and 16, respectively.

An electrically conductive film (electrode terminal) 12 of aluminum or the like is formed on a surface of the display frame. This conductive film 12 is electrically connected to the conductive film 12 formed on the anode plate 2 with an electrically conductive paste 13. The display frame 14 contacts an end portion of the spacer support plate 3.

The spacer support plate 3 is adhered to the anode plate 2 at an end portion outside the display area with a sealing member 17.

As shown in FIG. 2, the anode plate 2 contacts the spacer support plate 3 only partially and does not contact the spacers 7.

Figure 14:
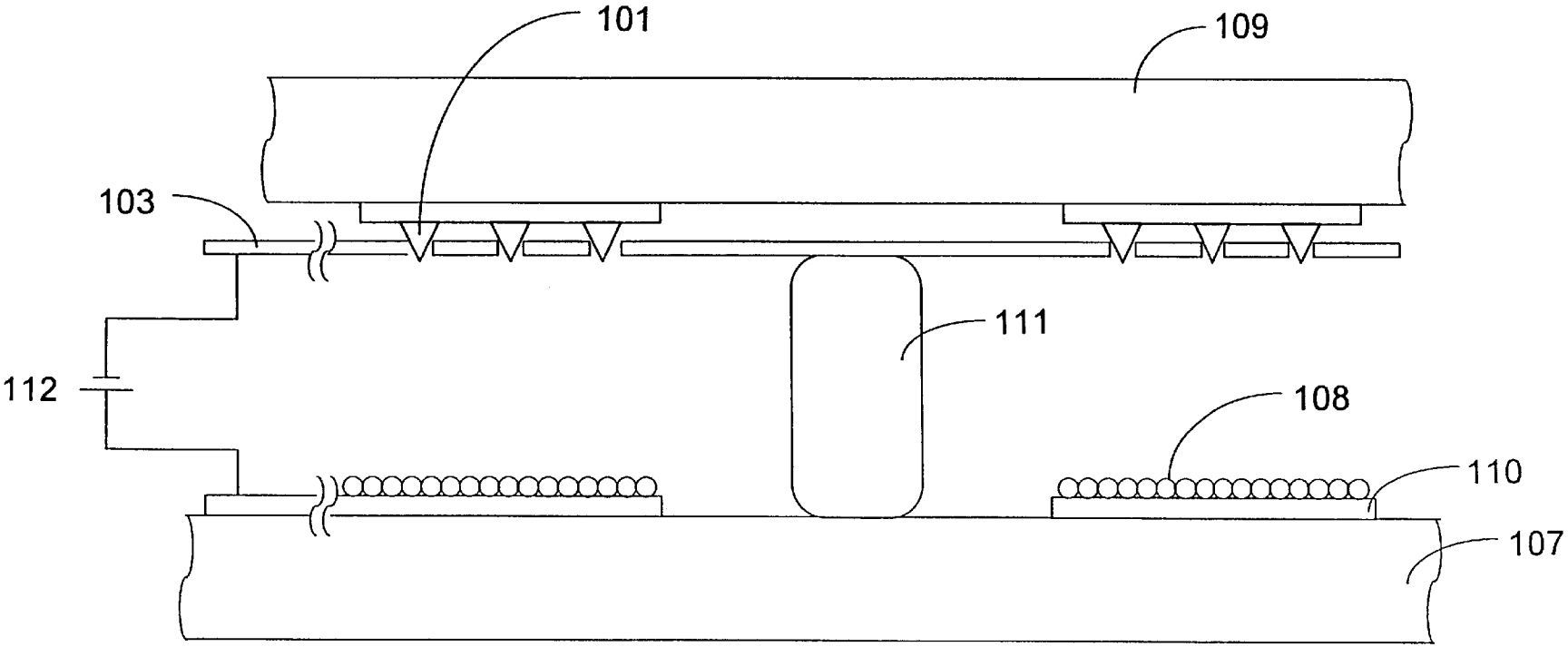
FIG. 14 is a sectional view of a reflection type display device.

A creeping distance from the conductive film 12 formed on the anode plate 2 to the surface of the cathode plate is the sum of the height of the sealing member 17, a distance on the surface of the spacer support plate and the height of the spacer 7. Here, the creeping distance can be set 5 mm or longer. In contrast, the creeping distance between the cathode plate and anode plate of the display device shown in FIG. 14 is about 0.3 mm.

Thus, according to the present invention, since the creeping distance between the cathode plate 1 and anode plate 2 becomes longer, electric discharge which is caused by secondary electrons or the like generated within the display device is less likely to take place on the surface of the spacers 7. That is, the insulation voltage can be improved from about 400V to about 2 KV.

Referring to FIG. 2, electrons emitted by the emitter tips 21 impinge on the fluorescent layer 10 to generate fluorescent light. In this example, the fluorescent light is observed from above the cathode plate in FIG. 2.

Gas generated when the fluorescent light is generated passes through the spacer through-holes 5 and the gas discharge through-holes 6 and then through the large through-holes 8 formed on the spacer support plate 3 and is adsorbed by the sheet getter 9. Therefore areas surrounding the emitter tips 21 are always kept in high vacuum.

Next, a process for producing the display device of Example 1 is now explained.

First, the spacer support plate 3 is formed of a substrate of a photosensitive glass on which through-holes of predetermined sizes are formed by patterning or the like. An example of the photosensitive glass is $Li_2O$—$K_2O$—$Al_2O_3$—$SiO_2$ glass containing a little amount of silver. This photosensitive glass substrate is irradiated with ultraviolet rays, heated to about 620° C. Then, a crystal of $Li_2O{\cdot}SiO_2$ soluble in hydrofluoric acid separates out in a site exposed to the ultraviolet rays. The spacer support plate 3 is provided with through-holes 8 having the largest possible surface area in the display area except where the spacers 7 is mounted.

The spacer 7 is formed 500 μm long by cutting a glass fiber in a cylindrical form of diameter about 40 μm and coating a side surface of the cut glass fiber with a resin of 10 μm thick. The spacer 7 is adhered to a predetermined site of the spacer support plate 3 with fritted glass so as to stand vertically to the spacer support plate 3. Several spacers 7 may be mounted in the display area at such proper intervals as prevent the cathode plate 1 from bending.

Next, anode plate 2 is formed of a substrate of a photosensitive glass of about 200 μm thick on which through-holes of predetermined sizes are formed at predetermined sites by patterning.

For example, as the gas discharge through-holes 6, circular through-holes of diameter about 50 μm are formed in matrix at a pitch of 150 μm in the display area on the anode plate 2 but not in the pixel areas.

Also as the spacer through-holes 5, circular through-holes of diameter about 70 μm are formed in the display area on the anode plate but not in the pixel areas.

On one surface of the anode plate 2, the electrically conductive film 12 is formed of aluminum or the like, on which the fluorescent layers are formed. Here, the fluorescent layers are formed in the pixel areas on the anode plate 2.

Then, the spacers 7 are passed through the spacer through-holes formed on the anode plate 2. The anode plate 2 and the spacer support plate 3 are aligned so that the spacers 7 do not contact the anode plate 2. The anode plate 2 and the spacer support plate 3 are attached to each other by adhering the peripheral portions thereof surrounding the display area with the sealing member 17 (fritted glass), and then calcined in the atmosphere.

This calcination decomposes and removes the resin applied to the side surface of the spacers 7.

Lastly, the spacers 7, the anode plate 2 and the cathode plate 1 are aligned, attached to each other with the sealing members 15, and further aligned with the display frame 14, the getter support plate 4 and the sheet getter 9 which are sealed with the sealing member 16 in vacuum.

The display device is produced according to the above-explained process. The spacing between the opposing surfaces of the anode plate 2 and the cathode plate 1 is about 250 μm. The display device can maintain as high resolution as the conventional display device exhibits.

As described above, the display device of the Example 1 is constructed so that the spacers 7 do not contact the anode plate 2 in the display area including the areas defining the pixels. Therefore, the electric discharge by secondary electrons caused by the contact of spacers with an anode plate can be prevented and thus the insulation voltage can be improved.

For example, an acceleration voltage of 2 KV which is almost five times as high as conventionally applied can be applied to the anode plate 2. This realizes a display device of high luminance.

In the above-described Example 1, the present invention has been explained as being constructed into a so-called reflection type display. However, a spacing member including the spacer support plate 3 and the spacers 7 of the present invention can be adapted for a transmission type display.

Figure 15:
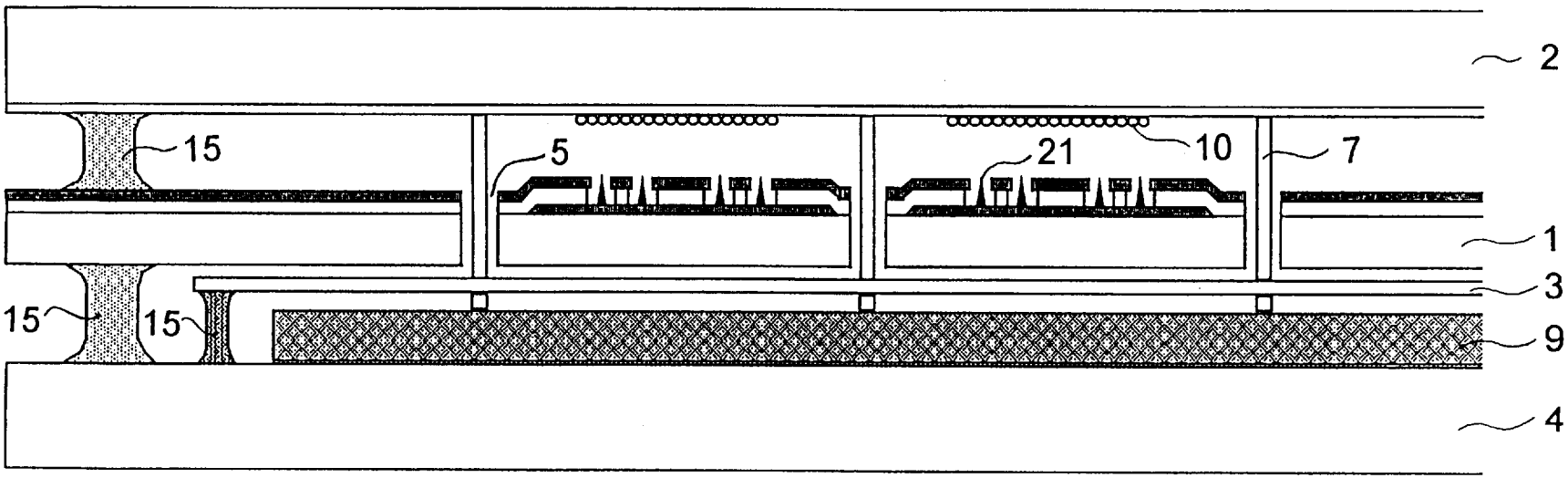
FIG. 15 is a sectional view of a transmission type display device in accordance with the present invention.

FIG. 15 shows a sectional view of a transmission type display of the present invention. In this case, a cathode plate 1 provided with emitter tips 21 formed on its surface is placed between an anode plate 2 and the getter support plate 4. The cathode plate 1 is provided with through-holes 5 for letting through spacers 7.

The cathode plate 1 is extended outside a sealing member 15 (to the left in FIG. 15) for allowing matrix wires for supplying power to the emitter tips 21 to be drawn out.

EXAMPLE 2

In Example 2, the spacer support plate is not provided. Instead, the backside of the anode plate is formed in a particular configuration to connect with spacers.

Figure 3:
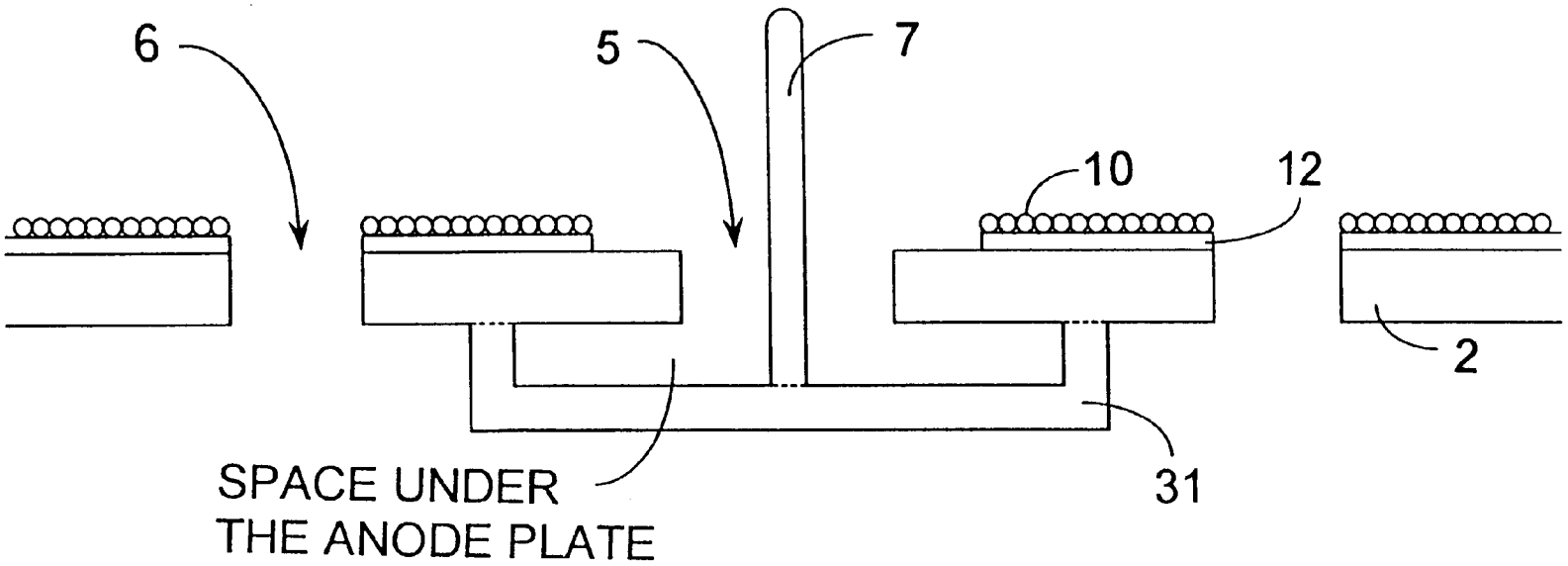
FIG. 3 is a sectional view illustrating an anode plate in accordance with Example 2 of the present invention.

FIG. 3 is a sectional view illustrating the anode plate of Example 2.

Similarly to Example 1, the spacers 7 are inserted through the spacer through-holes 5. The spacers 7 are connected with the anode plate 2 by U-shaped rear supports 31.

The rear support 31 extends downward from two spots on the backside of the anode plate 2 near the spacer through-hole 5 and turns to become parallel to the anode plate 2 and pass directly under the spacer through-hole 5 with defining a certain space between the backside of the anode plate and the rear support.

The spacer 7 and the rear support 31 are connected to each other below the spacer through-hole 5 as shown in FIG. 3.

Here, it is important to ensure a long creeping distance between the backside of the anode plate 2 and the spacer 7 via the rear support 31. Not only the shape of the rear support features this example.

Accordingly, the shape of the rear support 31 is not limited to the U-shape ensuring a certain space under the backside of the anode plate as shown in FIG. 3, but may be any shape which allows a long creeping distance from the backside of the anode plate 2 to the spacer 7. For example, the rear support 31 may have an undulated surface instead of a flat surface.

With the anode plate 2 of this structure, the insulation voltage can be improved since the creeping distance between the anode and cathode plates can be increased. Therefore, the acceleration voltage to the anode plate 2 can be increased to about 2 KV also in this example, which realizes improved luminance.

Figure 4:
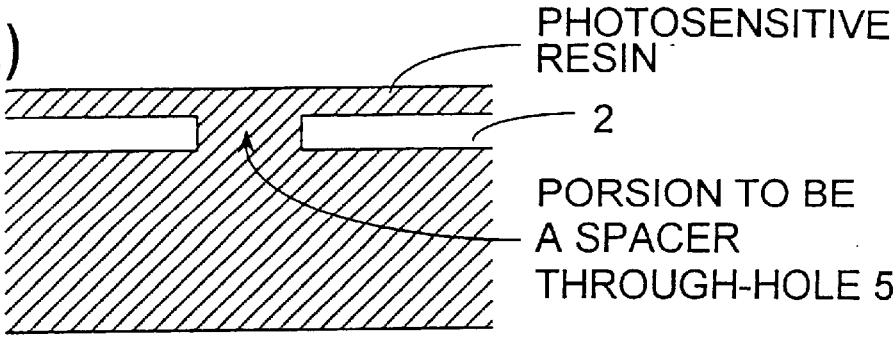
FIGS. 4(*a*) to 4(*e*) illustrate a process for producing the anode plate in accordance with Example 2 of the present invention.
Figure 4:
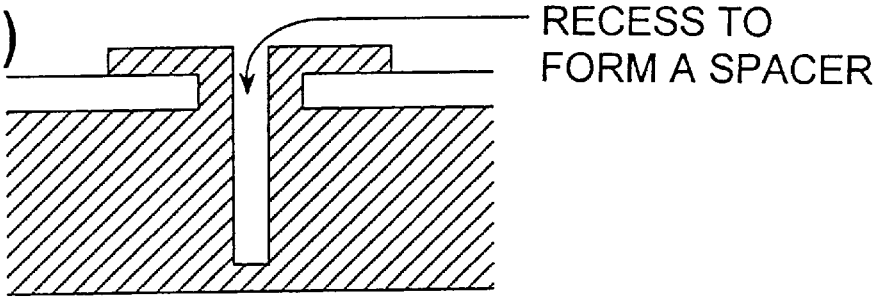
Figure 4:
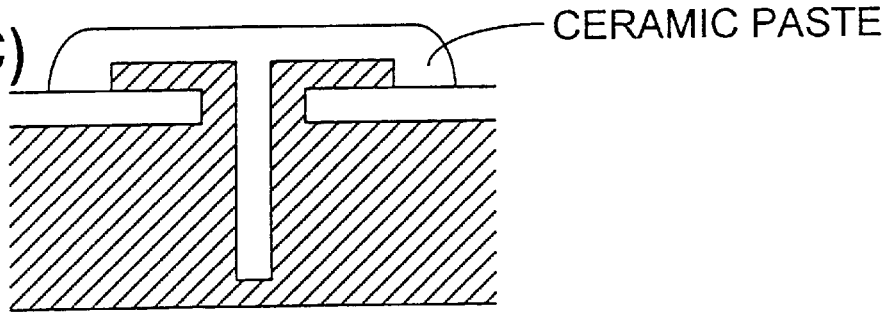
Figure 4:
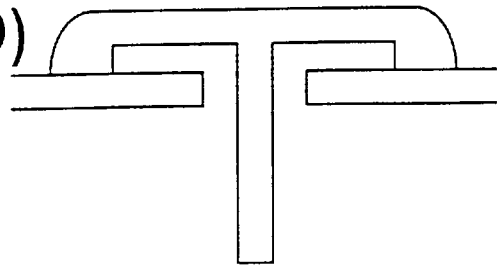
Figure 4:
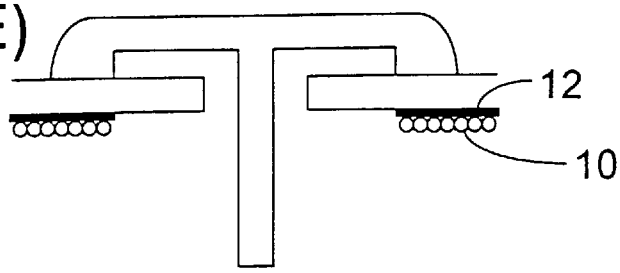

FIGS. 4(*a*) to 4(*e*) illustrate a process for producing the anode plate of Example 2.

Referring to FIG. 4(*a*), the anode plate 2 is a substrate of a photosensitive glass having the spacer through-holes 5 and the gas discharge through-holes 6 as shown in FIG. 1. A photosensitive resin is applied to all over the upper and lower surfaces of the glass plate to fill up all the through-holes.

Referring to FIG. 4(*b*), a pattern to mask all the glass plate except areas where the spacers are to be formed is put on the photosensitive resin, exposed to light and developed.

Thereby, parts (recesses) which will form spacers are formed as shown in FIG. 4(*b*).

Referring to FIG. 4(*c*), a ceramic paste is poured to fill up the recesses formed in FIG. 4(*b*) and calcined. Instead of pouring the ceramic paste, a glass fiber may be dropped into the recesses, followed by application of a ceramic paste to the circumference of the recesses and then by calcination.

By the calcination, the photosensitive resin are all decomposed and removed, and the anode plate 2 having a shape as shown in FIG. 4(*d*) is formed.

Further, electrically conductive films and fluorescent layers are formed in desired areas on the surface of the anode plate 2 using photolithography, and thereby the anode plate 2 as shown in FIG. 4(*e*) is completed.

If the anode plate of Example 2 is utilized in place of the anode plate shown in FIG. 1, the spacer support plate is no longer necessary, which reduces the number of steps for producing the display device.

Additionally, although FIG. 1 shows an example of the so-called reflection type display wherein a user observes display from above the cathode plate 1, the anode plate shown in FIG. 3 is also applicable to the so-called transmission type display generally used conventionally.

EXAMPLE 3

Figure 5:
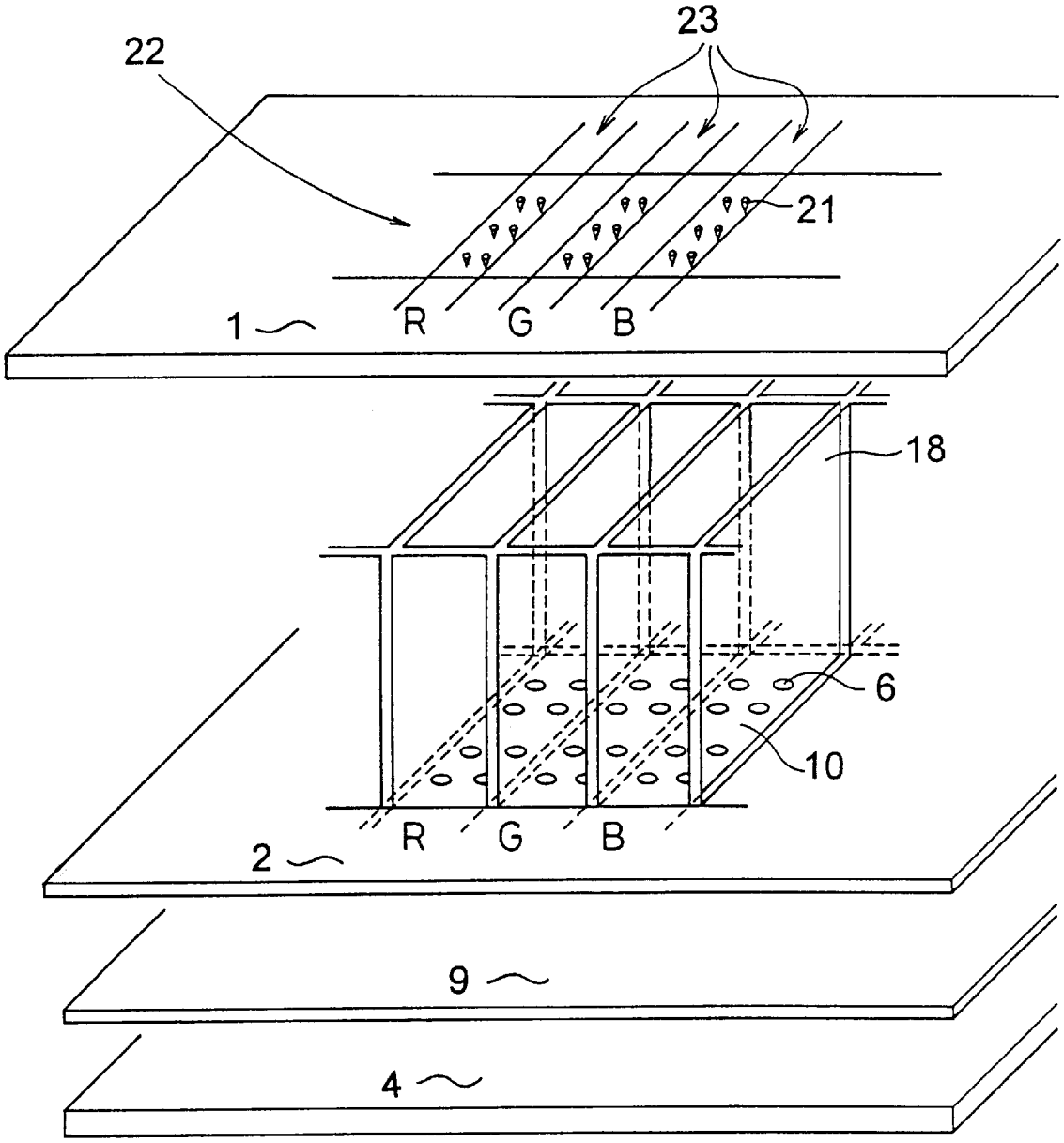
FIG. 5 is a schematic view illustrating the construction of a display device in accordance with Example 3 of the present invention.

FIG. 5 is a schematic view illustrating the construction of a display device of Example 3.

This example is different from the example shown in FIG. 1 in that the spacer support plate 3 is not used and a spacer 18 in the form of a lattice is used between a cathode plate 1 and an anode plate 2 in place of the spacers 7.

Since through-holes for letting through the spacers 7 are not required to be provided on the anode plate 2, the anode plate 2 is provided with only through-holes 6 for discharging gas.

Figure 6:
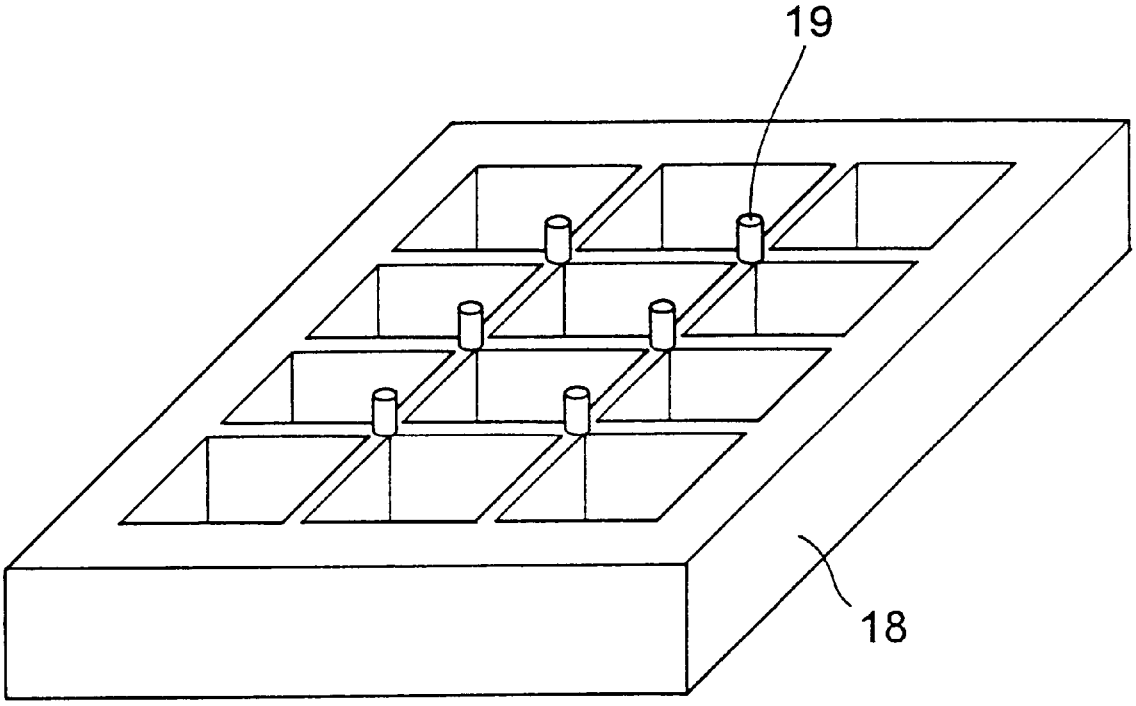
FIG. 6 is a perspective view illustrating a spacer in a lattice form in accordance with Example 3 of the present invention.

Here, the lattice spacer 18 is a one-piece spacer having rough-holes each corresponding to a pixel area. FIG. 6 shows an exemplary configuration of the lattice spacer 18.

In a color display, each through-hole corresponds to a pixel area of R, G or B and its size is about 5 mm×5 mm.

A lattice wall to isolate the pixel area may be about 40 μm in width and about 500 μm in height. The lattice spacer 18 of this configuration can prevent electrons emitted by a group of emitter tips belonging to one pixel area from impinging on a fluorescent layer in an adjacent pixel area. Therefore the blurring of colors can be prevented. Also, since the lattice structure allows the height to be raised, the insulation voltage can be improved from 400V to about 1 KV.

Referring to FIG. 6, at intersections of the walls of the lattice structure, there are provided projections 19 by which the lattice spacer 18 contacts the cathode plate 1 and the anode plate 2. FIG. 6 shows only projections on the upper surface of the lattice spacer 18, but it is preferable that projections are also provided on the lower surface (not shown) of the lattice spacer 18.

Without these projections 19, the entire upper surface of the lattice spacer contacts the cathode plate 1, and thereby wires of the gate or emitter electrode lines are under load. This is unfavorable for life of the wires.

In contrast, with the projections 19 as shown in FIG. 6, the lattice spacer 18 contacts the cathode plate 1 and the anode plate 2 only by the projections 19. Accordingly, by aligning the plates and the lattice spacer 18 so that the projections 19 come between the wires provided in matrix on the cathode plate 1, the wires can be prevented from receiving load, and therefore the short-circuiting and breaking of wires can be inhibited.

The projection 19 may be formed to be about 70 μm in diameter and about 50 μm in height. With the projections 19, the walls of the lattice spacer 18 maybe about 400 μm in height. In this case, the spacing between the cathode plate 1 and the anode plate 2 is also about 500 μm.

The projections 19 may be provided alternately at intersections on the upper surface and at intersections on the lower surface, not at all the intersections of the lattice structure.

Figure 7:
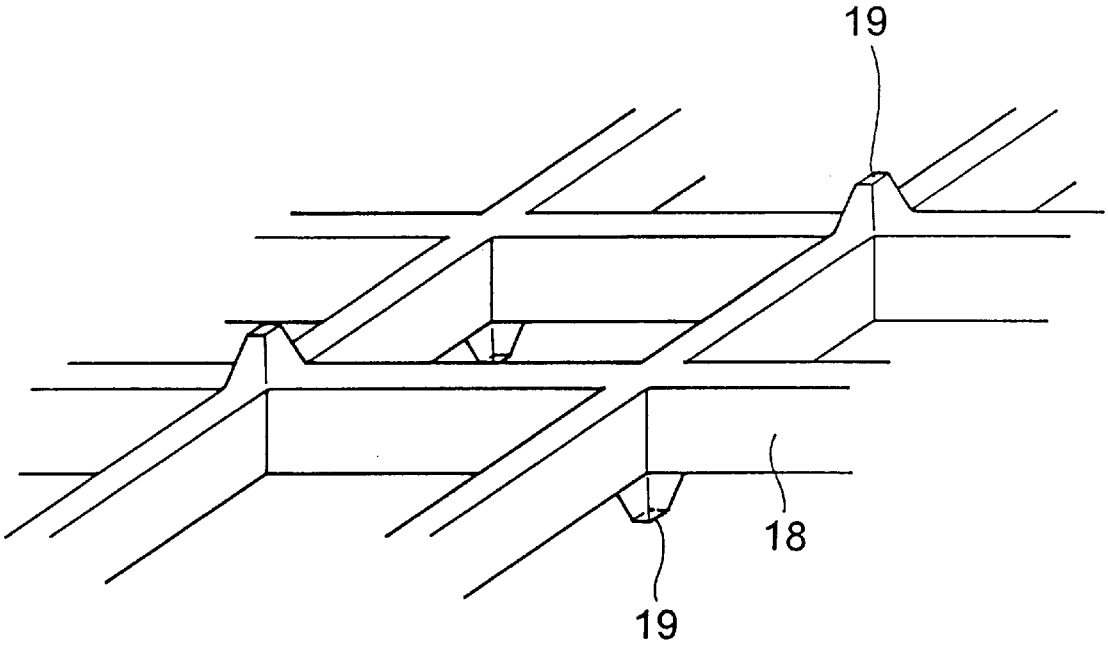
FIG. 7 is a perspective view illustrating a spacer in a lattice form provided with projections alternately mounted on an upper and a lower surface in accordance with the present invention.

FIG. 7 is a perspective view illustrating a lattice spacer provided with projections alternately mounted on the upper and lower surfaces.

The spacing between the cathode plate 1 and the anode plate 2 can be kept constant even with the projections mounted alternately on the upper and lower surfaces. Furthermore, this alternate setting of projections eliminates the shortest path from the cathode plate surface to the anode plate surface via the lattice spacer, thereby to lengthen the creeping distance therebetween. Accordingly, surface current caused by electric discharge does not easily flow on the lattice spacer. In this case, it is not necessary to provide a square of the lattice for each pixel as shown in FIG. 5. Accordingly, even if the spacing between the cathode plate 1 and the anode plate 2 is about 200 μm, the insulation voltage is improved to about 1 KV.

Figure 8:
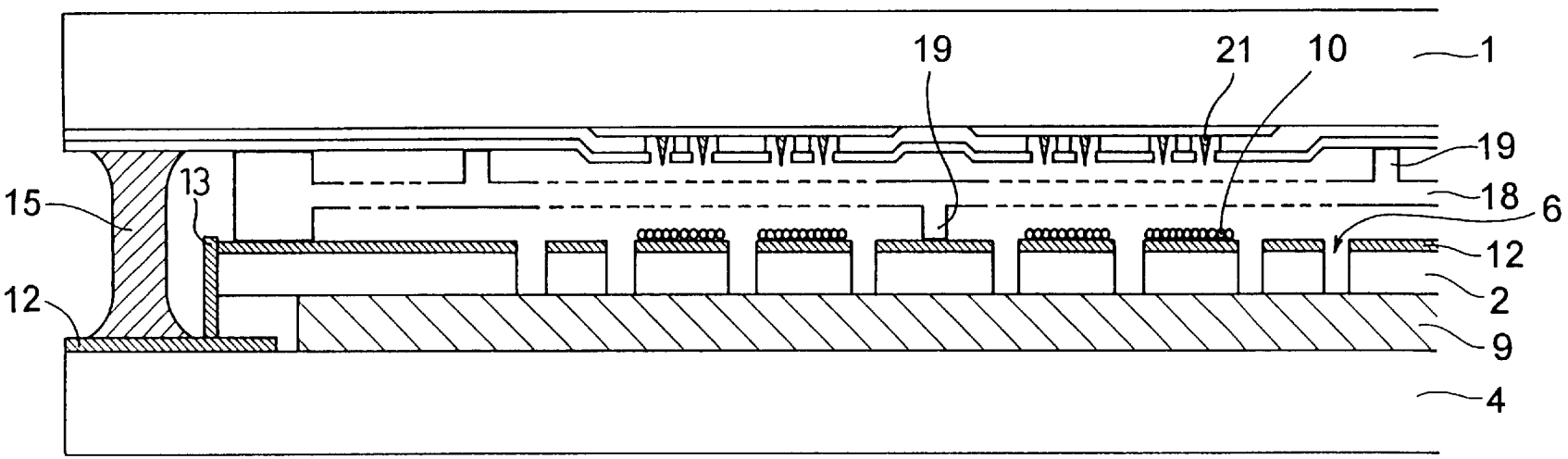
FIG. 8 is a sectional view illustrating a reflection type display device employing the lattice spacer shown in FIG. 7.

FIG. 8 is a sectional view illustrating a reflection type display employing the lattice spacer with the alternately provided projections 19. In this case, a user observes display from above the cathode plate 1 as in FIG. 1.

Figure 9:
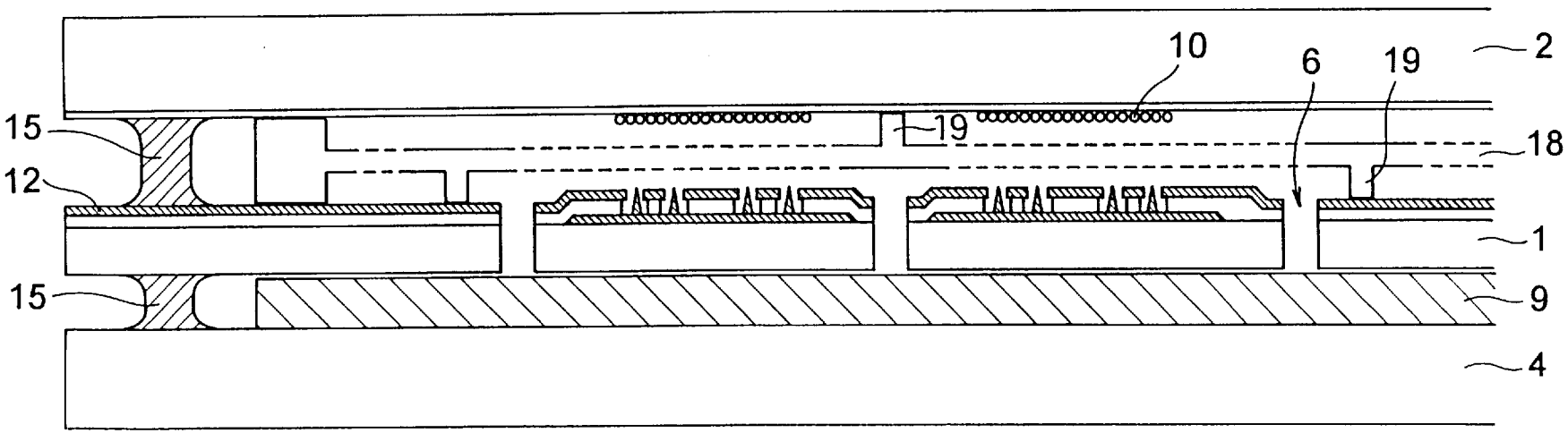
FIG. 9 is a sectional view illustrating a transmission type display device employing the lattice spacer shown in FIG. 7.

FIG. 9 is a sectional view illustrating a transmission type display employing the lattice spacer with the alternately provided projections 19. In this case, the relative position of the cathode plate 1 to the anode plate 2 is reverse to that shown in FIG. 1 and 8, but the form and size of the lattice spacer, the spacing between the cathode plate 1 and the anode plate 2, and others are the same. However, the gas discharge through-holes are provided not on the anode plate 2 but on the cathode plate 1. The display is observed from above the anode plate 2 in FIG. 9.

Figure 10:
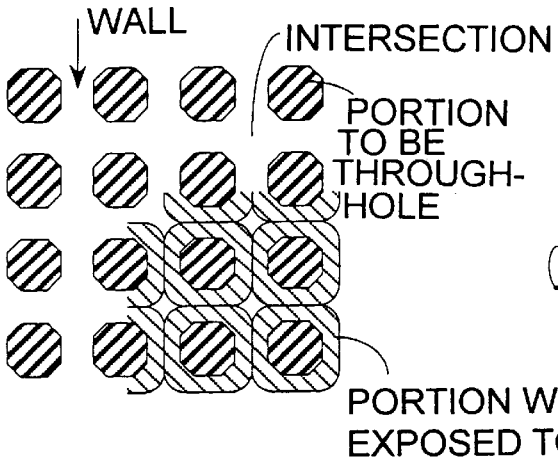
FIGS. 10(*a*) to 10(*f*) illustrate a process for producing the lattice spacer provided with projections alternately mounted on an upper and a lower surface in accordance with the present invention.
Figure 10:
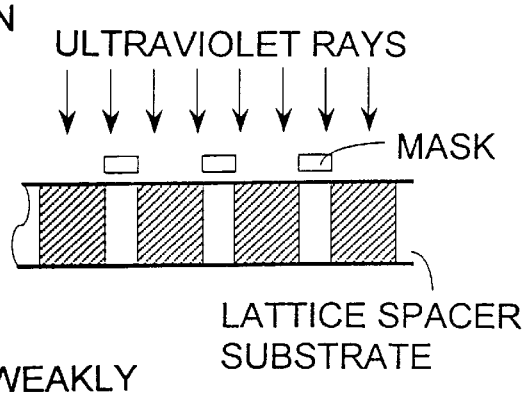
Figure 10:
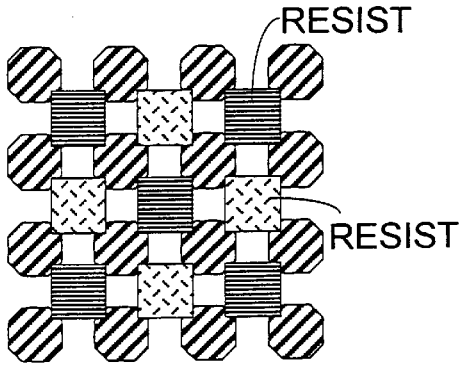
Figure 10:
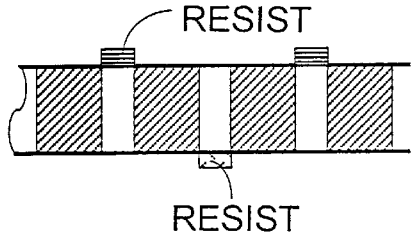
Figure 10:
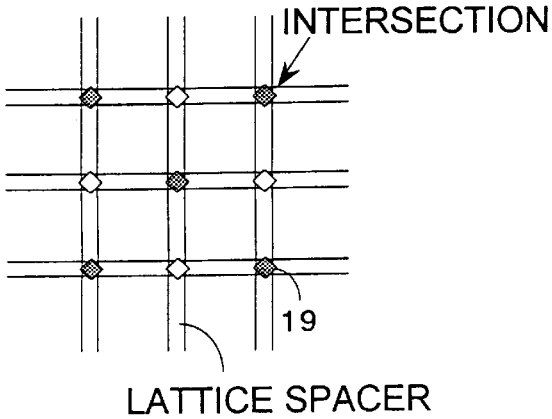
Figure 10:
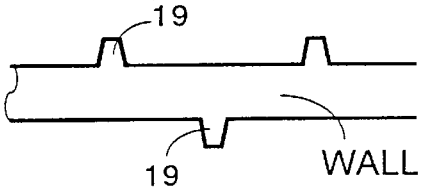

FIGS. 10(*a*) to 10(*f*) illustrate a process for producing the lattice spacer provided with projections 19 alternately mounted on the upper and lower surfaces.

Referring to FIG. 10(*a*), 10(*b*), a photosensitive glass substrate of 200 μm thick is irradiated with ultraviolet rays using a mask. In FIG. 10(*a*), shadowed sites are exposed to light.

The sites exposed to the ultraviolet rays are to be the through-holes shown in FIG. 7. The mask covers sites desired to be retained as a spacer substrate, i.e., sites corresponding to the walls of the lattice structure. Here, the masked intersections are about 100 μm in diameter, and the masked wall sites are 50 μm in width.

Then, the glass substrate is heated to 620° C. to be crystallized. By this process, the shadowed part in FIG. 10(*a*) becomes soluble in hydrofluoric acid.

Then, referring to FIG. 10(*c*), 10(*d*), a resist is applied to one surface of the glass substrate, which is then exposed to light for development. The resist is applied to every two intersections.

Similarly, the resist is applied to the other surface of the glass substrate, which is then exposed to light for development. This time, the resist is applied to intersections to which the resist have not been applied in the previous resist application.

Then the entire glass substrate is etched with hydrofluoric acid. Through the etching, the glass substrate is formed into a shape shown in FIG. 10(*e*), 10(*f*).

That is, since the exposed portions are crystallized by the above heat treatment, the exposed portions are etched readily, but unexposed portions, which are intended to become walls and projections, are hardly etched. However, as shown in FIG. 10(*a*), the ultra-violet rays slightly penetrate into part of the unexposed sites adjacent to the exposed sites. Accordingly, this part is weakly exposed and etched moderately.

The ultraviolet rays hardly penetrate into central parts of the masked sites, which are the centers of the intersections. Thus the centers of the intersections remains as projections after the etching.

Through the above described process, the glass substrate can be formed to have intersections of diameter 70 $\mu$m, walls of about 40 $\mu$m wide, projections of about 50 $\mu$m high and walls of about 100 $\mu$m high.

EXAMPLE 4

Figure 11:
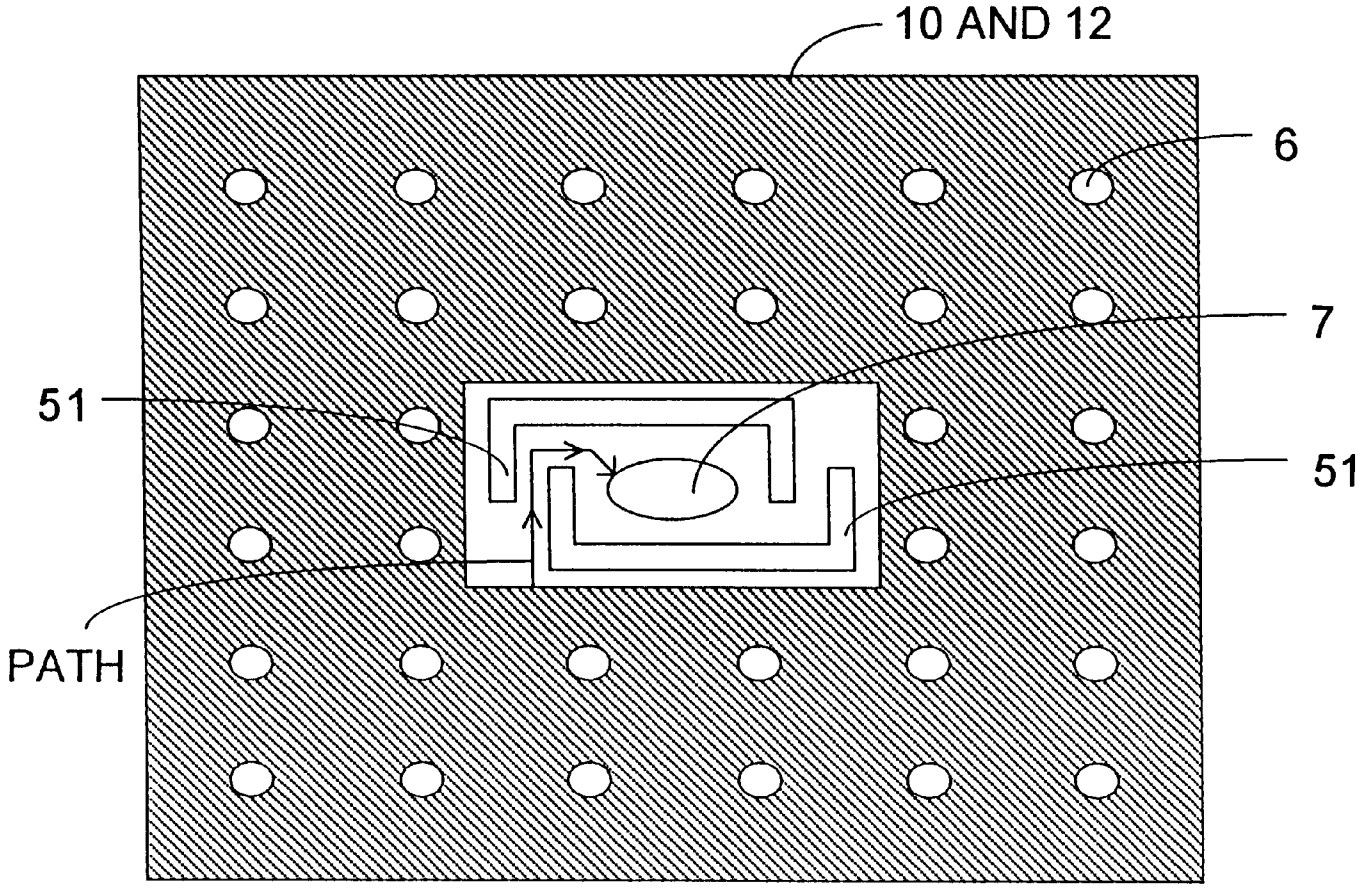
FIG. 11 is a plan view illustrating an anode plate having U-shaped through-holes in accordance with Example 4 of the present invention.

FIG. 11 is a plan view illustrating an anode plate of Example 4 of the present invention.

In this example, instead of the spacer support plate, a cylindrical spacer 7 is provided between the anode plate 2 and the cathode plate 1.

The anode plate 2 has an electrically conductive film 12 and a fluorescent layer 10 on a surface facing to the cathode plate 1. However, the electrically conductive film 12 and the fluorescent layer 10 are not provided in an area surrounding the spacer 7. This area is shown as a rectangular surrounding the spacer 7 in FIG. 11.

Farther, U-shaped through-holes 51 as shown in the figure are formed to surround the spacer 7 in the rectangular area of the anode plate 2 in which the electrically conductive film 12 and the fluorescent layer 10 are not provided.

With such through-holes 51, there does not exist a straight-line path from the electrically conductive film 12 on the anode plate 2 to the spacer 7. Since the path from the electrically conductive film 12 to the spacer 7 forms a curved line as shown in the figure, the creeping distance between the electrically conductive film 12 and the spacer 7 becomes longer.

Figure 12:
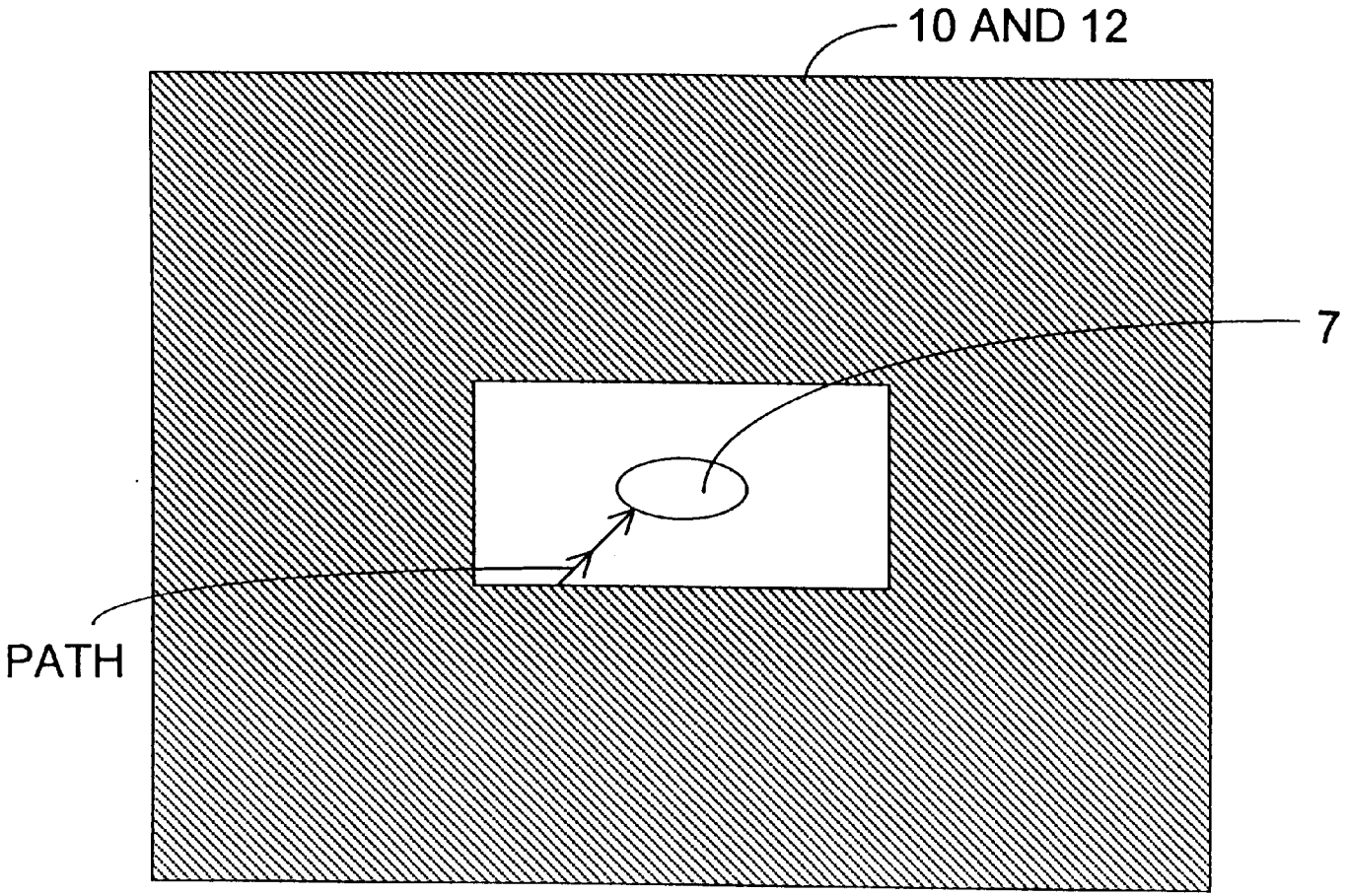
FIG.12 (Prior Art)
FIG. 12 is a plan view illustrating a conventional anode plate of a conventional display device.
Figures 13A, 13B:
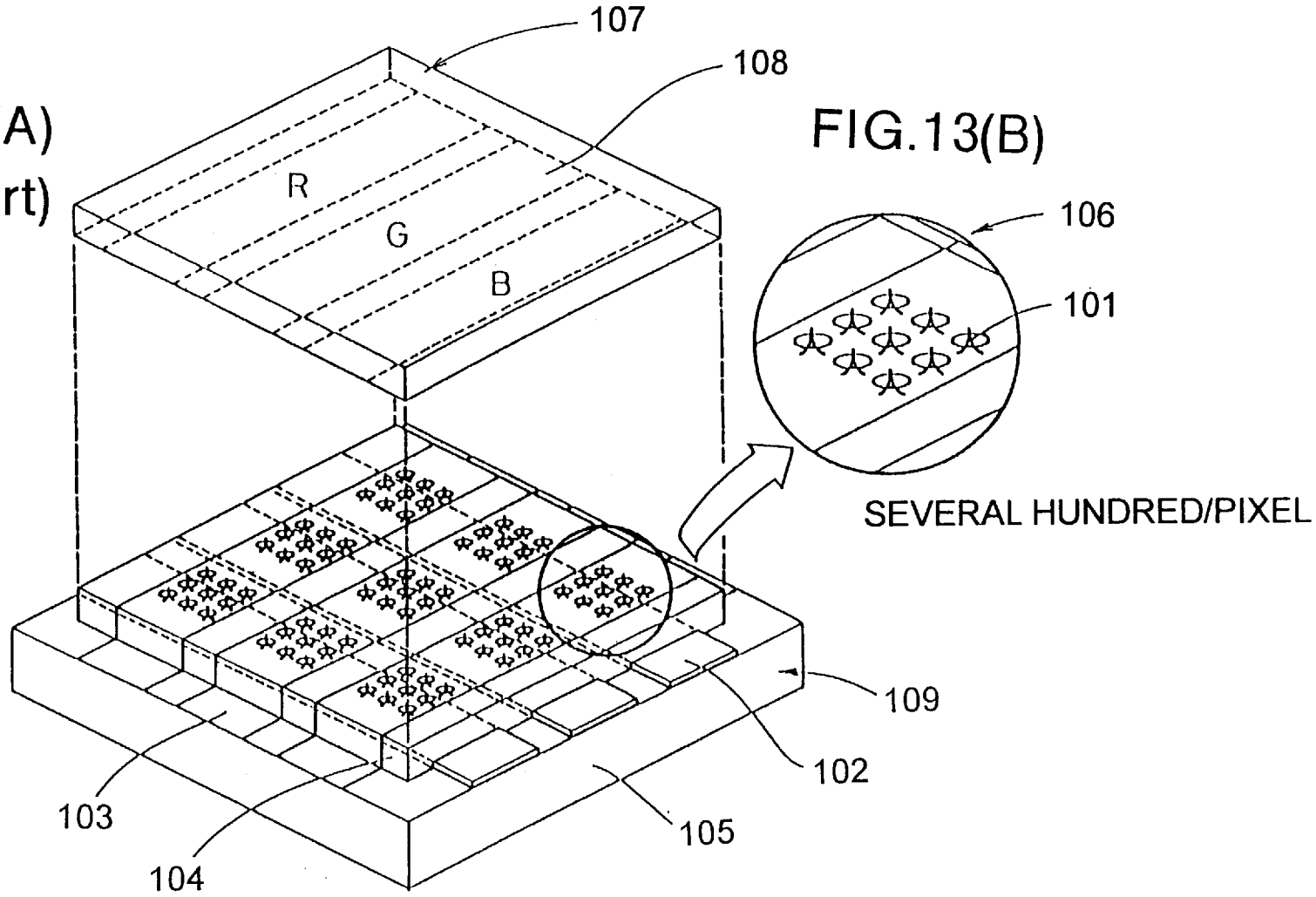
FIG.13(A) (Prior Art)
FIGS. 13(*a*) and 13(*b*) are is a schematic view illustrating the construction of a conventional display device.

FIG. 12 is a plan view illustrating a conventional anode plate of a conventional display device. Here, an electrically conductive film 12 and a fluorescent layer 10 are partially removed in an area surounding the spacer 7. As shown in the figure, the creeping distance between the conductive film 12 and the spacer 7 is a straight line and therefore is short.

Comparing FIG. 11 with FIG. 12, the creeping distance is longer in Example 4 of the present invention shown in FIG. 11 than in the prior art, and therefore the present invention can improve the insulation voltage.

Additionally, although the example shown in FIG. 11 has two U-shaped through-holes 51, the through-holes are not limited to a U-shape, but may be in another shape such as a spiral. In other words, the through-hole 51 has only to be provided around the spacer 7 in such a shape as makes longer the creeping distance between the conductive film 12 on the anode plate 2 and the spacer 7.

In the above-described examples, the emitter tips are shown in a conic shape. However, the emitter tips are not limited to this shape, but may be of a flat type as shown in Japanese Unexamined Patent publication (Kokai) No. HEI8 (1996)-180795.

With the construction of the present invention, since the spacer and the anode plate do not contact each other in the display area including the areas defining the pixels, the insulation voltage can be improved. Thus a display device of high luminance can be realized while high resolution is maintained.

Further, since the spacer member and the anode plate are connected with each other with a significant distance therebetween through the support member, the creeping distance between the anode plate and the cathode plate can be lengthened, and the insulation voltage and the luminance can be improved.

Still further, with the construction in which the lattice spacer member are provided between the anode plate and the cathode plate, the color blurring can be prevented in the color display.

Further, with the projections provided at the respective intersections of the lattice spacer, the insulation voltage and the luminance can be improved.

What is claimed is:

1. A display device comprising:

a cathode plate having a minute field emission cathode to emit electrons into an area defining a pixel;

an anode plate having a fluorescent layer in the area defining the pixel; and a single spacer support member in a lattice form;

wherein the single spacer support member is placed in a space defined by the cathode plate and the anode plate, and the single spacer support member has a plurality of through-holes opening in a direction from the cathode plate to the anode plate, and the through-holes correspond to the areas defining pixels.

2. A display device according to claim 1, wherein the single spacer support member is provided with a projection at each intersection, and the cathode plate and the anode plate connect with the single spacer support member through the projection.

3. A display device according to claim 2, wherein the projection of the single spacer support member contacting the cathode plate and the projection of the single spacer support member contacting the anode plate do not coexist on the same intersection of the single spacer support member.

4. A display device according to claim 1, wherein the single spacer support member is formed as a one-piece lattice structure.

* * * * *